United States Patent [19]

Izumihara

[11] 4,242,166

[45] Dec. 30, 1980

[54] THERMAL STAMPING APPARATUS

[75] Inventor: Hiroshi Izumihara, Gose, Japan

[73] Assignee: Taihei Industries Co., Ltd., Osaka, Japan

[21] Appl. No.: 96,878

[22] Filed: Nov. 23, 1979

[30] Foreign Application Priority Data

Dec. 18, 1978 [JP] Japan ..... 53-156715

[51] Int. Cl.[3] ..... G05G 15/00

[52] U.S. Cl. ..... 156/351; 101/38 R; 156/359

[58] Field of Search ..... 156/350, 357, 359, 378, 156/540, 542; 101/6–8, 38 R, 38 A, 39

[56] References Cited

U.S. PATENT DOCUMENTS

| | | | |
|---|---|---|---|
| 3,313,667 | 4/1967 | Flood | 156/542 |
| 3,540,968 | 11/1970 | White | 156/542 X |
| 3,975,226 | 8/1976 | Boettcher | 156/359 X |
| 4,194,944 | 3/1980 | Spätle | 101/7 X |

*Primary Examiner*—David A. Simmons

*Attorney, Agent, or Firm*—Griffin, Branigan & Butler

[57] ABSTRACT

A thermal stamping apparatus wherein the speed at which a heat transfer roll traverses the surface of an object can be varied in response to changes in the surface temperature of the transfer roll.

3 Claims, 2 Drawing Figures

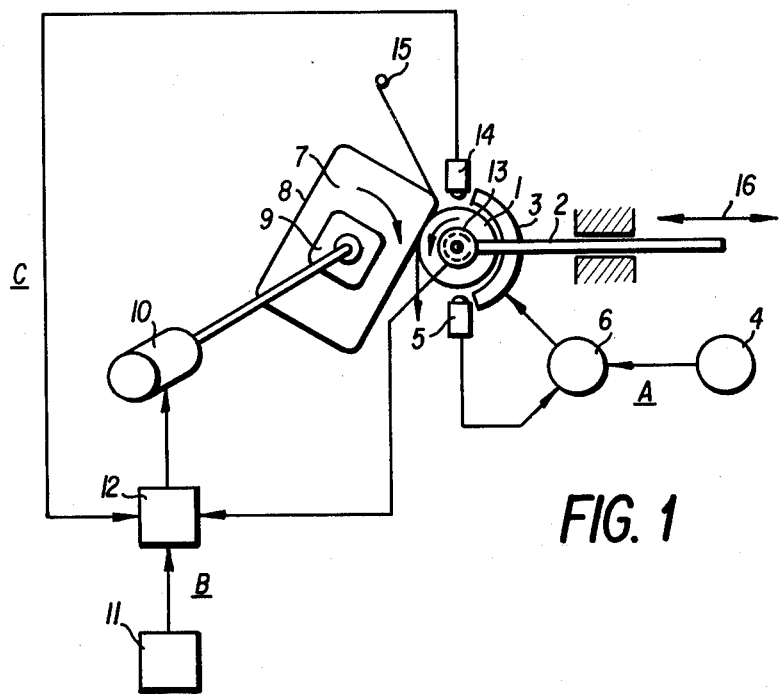
FIG. 1
FIG. 2
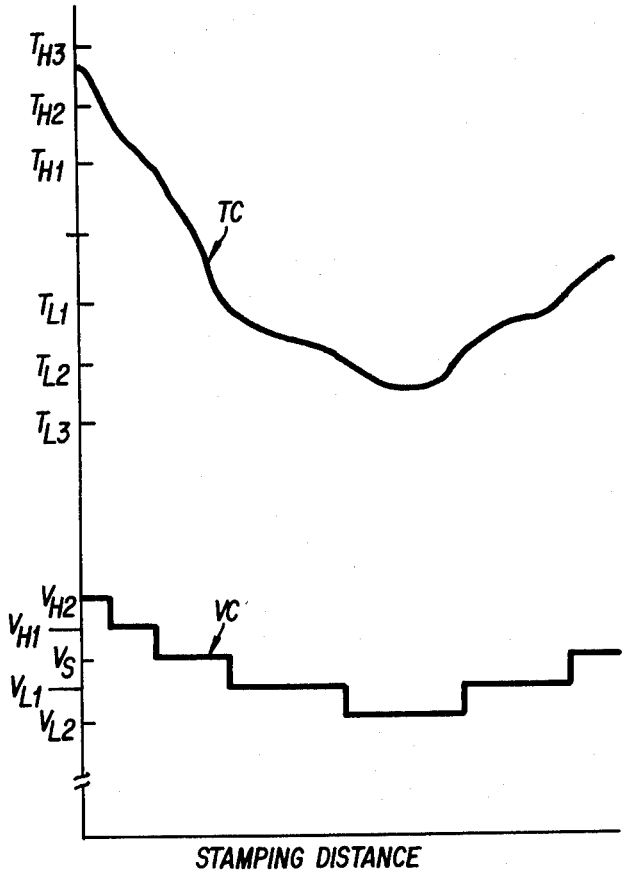

THERMAL STAMPING APPARATUS

BACKGROUND

Broadly, this invention relates to a thermal stamping apparatus for stamping or transferring a film to the outer surface of an object utilizing a heat transfer roll, and more particularly to such an apparatus wherein the amount of heat transferred by the roll to the film during the stamping operation can be maintained within a set range.

Stamping devices are known for transferring a film from a carrier or backing member to the outer surface of an object utilizing a heat transfer roll. Generally, the object to be stamped is mounted to a rotary jig and a carrier or backing member carrying the film to be transferred is fed between the transfer roll and the object as the jig rotates. When the film is pressed against the surface of the object while heated by the transfer roll, a heat sensitive adhesive layer on the film is activated and attaches the film to the outer surface of the object. In order to provide uniform and continuous stamping, it is necessary to maintain the amount of heat transferred to the film within an optimum range at all times.

Prior art devices are known that detect the surface temperature of the transfer roll utilizing a temperature sensor which controls a heater adapted to heat the transfer roll. This arrangement is intended to maintain the surface temperature of the transfer roll within a predetermined range. However, when the surface temperature of the transfer roll deviates from the pre-determined range, a time lag is experienced between the detection of the deviation and the response of the heater. Further, an additional time lag is experienced while the transfer roll acquires the desired temperature range. during the time lag, defective stamping may occur.

Since the amount of heat transferred from the transfer roll to the film is attributed to direct heat conduction, the amount of heat transferred is determined by multiplying the surface temperature of the roll by the time period during which the film remains in contact with the transfer roll. Therefore, it is possible to maintain the rate of heat transfer at a constant even when the surface temperature of the roll deviates from the pre-set range by varying the speed at which the transfer roll traverses the surface of the object.

SUMMARY

It is an object of the present invention to provide a thermal stamping device wherein the surface temperature of a transfer roll is detected immediately before the stamping operation so that the stamping speed can be varied in response to changes in the surface temperature of the roll such that the amount of heat transferred by the roll to the film can be maintained within a pre-determined range.

In accordance with the principles of the present invention, a thermal stamping device includes a heat transfer roll heated by a heater having a temperature control system wherein the thermal transfer roll contacts the outer surface of an object mounted to a rotary jig so that a carrier having a film is fed between the transfer roll and the object as the jig rotates. A speed control system is provided for controlling the stamping speed of the transfer roll, the speed control system including a speed varying system to vary the speed at which the transfer roll traverses the surface of the object in accordance with changes in the surface temperature of the transfer roll as sensed immediately before the stamping operation.

BRIEF DESCRIPTION OF THE DRAWINGS

The foregoing and other objects, features, and advantages of the invention will be apparent from a more particular description of the preferred embodiment of the invention as illustrated in the accompanying drawings. The drawings are not necessarily to scale, emphasis instead being placed on illustrating the principles of the invention.

FIG. 1 illustrates an embodiment of the present invention; and

FIG. 2 illustrates the relationship of the surface temperature of the transfer roll with the corresponding stamping speed.

DETAILED DESCRIPTION

Referring to FIG. 1, a thermal stamping device is illustrated comprising a heat transfer roll 1 constructed from a suitable heat resistant and resilient material such as silicone rubber. The transfer roll 1 is rotatably mounted on a frame 2 which is adapted to move back and forth as indicated by arrow 16.

Also supported on frame 2 is a heater 3 formed from a semi-circular section and arranged adjacent to the surface of the transfer roll 1. The operation of the heater 3 is regulated by a temperature control system A comprising a temperature regulator 4, a temperature sensor 5 and a temperature control circuit 6.

In operation, the desired surface temperature of the transfer roll 1 is set by regulator 4 and the temperature sensor 5 detects the surface temperature of the transfer roll 1. The temperature control circuit 6 compares the value set by the regulator 4 with the detected value and operates the heater 3 to nullify any variations.

Again referring to FIG. 1, a product 7 (such as a television cabinet) is rotatably supported by a rotary jig arrangement 9 which positions the product 7 adjacent to the transfer roll 1 so that the outer peripheral surface 8 of the product 7 can be contacted by the transfer roll 1. A suitable drive unit 10 (such as an electric power or oil pressure motor) is provided to rotate the rotary jig arrangement 9 under the supervision of a speed control circuit B including a speed regulator or set point control 11, a speed control circuit 12 and a speed sensor 13.

During the stamping operation, the transfer roll 1 contacts the outer peripheral surface 8 of the product 7 mounted to the rotary jig arrangement 9 so that a film 15 with a carrier backing is fed between the transfer roll 1 and the product 7 as the jig rotates. Since the product 7 has a non-circular outer peripheral surface 8, the circumferential speed of rotation of roller 1 varies as the angular speed of rotation of the product 7 is maintained constant. Therefore, in order to maintain a constant stamping speed, the speed sensor 13 detects the circumferential rate of rotation of the transfer roll 1. This detected value is applied to the speed control circuit 12 so that the angular speed of the product 7 can be adjusted to provide a constant circumferential speed of roll 1 corresponding to a desired stamping speed.

Also provided is a speed modifying system C adapted to vary the stamping speed in accordance with fluctuations in the surface temperature of the transfer roll 1. In this regard, a temperature sensor 14 is provided to detect the surface temperature of the transfer roll 1 immediately before the stamping operation as illustrated in FIG. 1.

During stamping, the transfer roll 1 is heated by the heater 3 under the control of the temperature control system A, thereby heating the film 15 as it is pressed against the outer surface 8 of the product 7. The amount of heat transferred from the transfer roll 1 to the film 15 during the stamping operation can be determined by both the surface temperature of the transfer roll 1 and the stamping speed corresponding to the rate of rotation of the transfer roll 1. Since the surface temperature of the transfer roll 1 cannot be directly controlled by the temperature control system A but rather only indirectly controlled by the regulation of the heater 3 by the temperature control system A, a time lag is experienced between the detection of a variation in the desired stamping temperature and the time the temperature of the transfer roll changes in response to the heater. As a result, the surface temperature of the transfer roll 1 will vary during the time lag, as shown in FIG. 2 by curve TC.

In order to mitigate the deleterious effect of temperature fluctations, the speed control circuit 12 of the speed control system B varies the rate of revolution of the rotary jig arrangement 9 in accordance with the surface temperature T detected by the temperature sensor 14 so as to vary the stamping speed V.

The relationship between the surface temperature T of the transfer roll 1 detected by the temperature sensor 14 with respect to the stamping speed V adjusted by changes in the surface temperature T can be best understood with reference to FIG. 2. Assume the allowable temperature range for providing continuous and uniform stamping is defined by TH3-TL3 where TH3 is the maximum allowable temperature and TL3 is the lowest allowable temperature. Since the amount of heat transferred to the film 15 during the stamping operation can be determined by multiplying the surface temperature T by the time period during which the transfer roll 1 remains in contact with the film 15, the stamping speed V is inversely proportional to the time period. Accordingly, the shorter the time period necessary to transfer the requisite quanta of heat, the higher the stamping speed allowable. Consequently, the longer the time period required, the slower the stamping speed necessary.

When the surface temperature T is in a predetermined temperature range of TH1-TL1, the optimum stamping speed necessary to conduct the required amount of heat to the film 15 is defined by Vs. When the surface temperature T of the transfer roll 1 occupies a range between TH1-TH2, TH2-TH3, TL1-TL2 and TL2-TL3 the optimum stamping speeds are defined by VH1, VH2, VL1, and VL2, respectively.

Again referring to FIG. 2, as the surface temperature T of transfer roll 1 varies as illustrated by curve TC, the corresponding stamping speed V is modified by the speed modification system C as illustrated by curve VC. In this manner, the amount of heat transferred to the film 15 can be maintained constant at all times.

While the invention has been particularly shown and described with reference to a preferred embodiment thereof, it will be understood by those skilled in the art that various alterations in form and detail can be made therein without departing from the spirit and scope of the invention. For example, the variation fo the stamping speed V need not take the form of a stepwise change, but rather, the variation may be more finely divided to provide a continuous variation of the stamping speed V.

The embodiments of the invention in which an exclusive property right or privilege is claimed is defined by the following claims:

1. A thermal stamping device for transferring a film from its carrier to the surface of an object to which said film is to be adhered, said device comprising:

a heat transfer roll for pressing said film and its carrier toward said surface as said transfer roll rolls over said surface;

a heater for heating said transfer roll;

a temperature control means for controlling said heater;

drive means for rotatably supporting said object adjacent said transfer roll, said drive means including speed control means for controlling the stamping speed at which said transfer roll traverses said surface; and, speed modifying means for controlling said speed control means to vary said stamping speed in accordance with variations in the surface temperature of said transfer roll.

2. A thermal stamping device as claimed in claim 1 wherein said speed modifying means includes a heat detector disposed immediately preceding the region where said transfer roll presses said film and its carrier toward said surface; said heat detector producing an output signal which varies in accordance with the surface temperature of said transfer roll, and means for applying said output signal to said speed control means.

3. A thermal stamping device as claimed in claim 2 wherein said drive means comprises a motor and said speed control means comprises a set point regulator, a speed detector for sensing the rotational speed of said transfer roll, and a controller responsive to said speed detector and said set point regulator for controlling said motor whereby said transfer roll normally traverses the surface of said object at a predetermined set point speed, said output signal being applied to said controller to increase or decrease the speed of said transfer roll as the temperature sensed by said heat detector means increases or decreases, respectively.

* * * * *